US009392875B2

(12) United States Patent
Weyl

(10) Patent No.: US 9,392,875 B2
(45) Date of Patent: Jul. 19, 2016

(54) BODY SUPPORT SYSTEM WITH COMBINATION OF PRESSURE REDISTRIBUTION AND INTERNAL AIR FLOW GUIDE(S) FOR WITHDRAWING HEAT AND MOISTURE AWAY FROM BODY RECLINING ON SUPPORT SURFACE OF BODY SUPPORT SYSTEM

(71) Applicant: FXI, Inc., Media, PA (US)

(72) Inventor: Christopher S. Weyl, Landenberg, PA (US)

(73) Assignee: FXI, Inc., Media, PA (US)

( * ) Notice: Subject to any disclaimer, the term of this patent is extended or adjusted under 35 U.S.C. 154(b) by 0 days.

(21) Appl. No.: 13/744,940

(22) Filed: Jan. 18, 2013

(65) Prior Publication Data

US 2014/0201909 A1 Jul. 24, 2014

(51) Int. Cl.
*A47C 21/04* (2006.01)
*A61G 7/057* (2006.01)

(52) U.S. Cl.
CPC ..... *A47C 21/044* (2013.01); *A61G 7/05715* (2013.01); *A61G 7/05746* (2013.01); *A61G 7/05776* (2013.01); *A61G 2007/05784* (2013.01); *A61G 2007/05792* (2013.01); *A61G 2203/12* (2013.01); *A61G 2210/70* (2013.01)

(58) Field of Classification Search
CPC ..... A47C 21/044; A47C 7/74; A47C 21/04; A47C 7/744; A47C 21/042; A47C 27/007; A47C 7/742; A61G 2007/05784; A61G 7/057; A61G 2007/0514; A61G 7/05746; A61F 7/0097; A61F 2007/0058; A47G 9/0215
USPC ..... 5/423, 652.2, 726, 655.9, 740, 953
See application file for complete search history.

(56) References Cited

U.S. PATENT DOCUMENTS 2,425,655 A 8/1947 Tompkins
3,101,488 A * 8/1963 Peebles ..... 5/423
3,266,064 A 8/1966 Figman
3,486,177 A * 12/1969 Marshack ..... 5/726

(Continued)

FOREIGN PATENT DOCUMENTS

EP 1308112 A1 5/2003
EP 2000057 A1 12/2008

(Continued)

OTHER PUBLICATIONS

Int'l Search Report and Written Opinion issued Mar. 24, 2014 in Int'l Application No. PCT/US2013/075375.

(Continued)

*Primary Examiner* — David E Sosnowski
*Assistant Examiner* — Eric Kurilla
(74) *Attorney, Agent, or Firm* — Panitch Schwarze Belisario & Nadel LLP

(57) ABSTRACT

Body support systems include central cores having one or more internal air flow guides that form part of each system for pressure redistribution, and withdrawal of heat and moisture away from an uppermost comfort layer or body-supporting layer(s). During operation of the system, heat and/or moisture is directed from the uppermost comfort layer or body-supporting layer(s) into the central core portion of the body support system and out of the body support system. The internal air flow guide(s) are formed of cellular polymer material and are coupled to the uppermost comfort layer to form an air flow path.

13 Claims, 8 Drawing Sheets

(56) References Cited

U.S. PATENT DOCUMENTS

| | | | | |
|---|---|---|---|---|
| 3,644,950 | A | 2/1972 | Lindsay, Jr. | |
| 4,057,861 | A * | 11/1977 | Howorth | 5/726 |
| 4,694,521 | A | 9/1987 | Tominaga | |
| 4,825,488 | A | 5/1989 | Bedford | |
| 5,249,319 | A | 10/1993 | Higgs | |
| 5,325,551 | A | 7/1994 | Tappel et al. | |
| 5,493,742 | A | 2/1996 | Klearman | |
| 5,566,409 | A | 10/1996 | Klearman | |
| 5,606,756 | A | 3/1997 | Price | |
| 5,699,570 | A | 12/1997 | Wilkinson et al. | |
| 5,745,941 | A | 5/1998 | Miller, Sr. | |
| 5,794,289 | A * | 8/1998 | Wortman et al. | 5/713 |
| 5,819,349 | A * | 10/1998 | Schwartz | 5/740 |
| 5,882,349 | A | 3/1999 | Wilkerson et al. | |
| 5,991,949 | A | 11/1999 | Miller, Sr. et al. | |
| 6,108,842 | A * | 8/2000 | Severinski et al. | 5/653 |
| 6,109,688 | A * | 8/2000 | Wurz et al. | 297/180.14 |
| 6,158,070 | A | 12/2000 | Bolden et al. | |
| 6,159,574 | A | 12/2000 | Landvik et al. | |
| 6,272,707 | B1 | 8/2001 | Robrecht et al. | |
| 6,273,810 | B1 | 8/2001 | Rhodes, Jr. et al. | |
| 6,336,237 | B1 | 1/2002 | Schmid | |
| 6,402,775 | B1 * | 6/2002 | Bieberich | 607/104 |
| 6,484,334 | B1 | 11/2002 | Borders et al. | |
| 6,516,483 | B1 | 2/2003 | VanSteenburg | |
| 6,541,094 | B1 | 4/2003 | Landvik et al. | |
| 6,591,437 | B1 | 7/2003 | Phillips | |
| 6,643,875 | B2 | 11/2003 | Boso et al. | |
| 6,684,434 | B2 | 2/2004 | Ellis et al. | |
| 6,701,558 | B2 | 3/2004 | VanSteenburg | |
| 6,721,979 | B1 | 4/2004 | Vrzalik et al. | |
| 6,789,284 | B2 | 9/2004 | Kemp | |
| 6,793,469 | B2 | 9/2004 | Chung | |
| 6,832,398 | B2 | 12/2004 | Borders et al. | |
| 6,952,852 | B2 * | 10/2005 | Reeder et al. | 5/727 |
| 7,065,815 | B2 | 6/2006 | Buchanan | |
| 7,120,950 | B2 | 10/2006 | Garrigues | |
| 7,240,386 | B1 * | 7/2007 | McKay et al. | 5/724 |
| 7,255,917 | B2 | 8/2007 | Rochlin et al. | |
| 7,467,435 | B1 | 12/2008 | McKay et al. | |
| 7,469,432 | B2 | 12/2008 | Chambers | |
| 7,469,437 | B2 | 12/2008 | Mikkelsen et al. | |
| 7,480,953 | B2 | 1/2009 | Romano et al. | |
| 7,507,468 | B2 | 3/2009 | Landvik et al. | |
| 7,617,555 | B2 | 11/2009 | Romano et al. | |
| 7,661,163 | B1 | 2/2010 | Gallaher | |
| 7,712,164 | B2 | 5/2010 | Chambers | |
| 7,802,334 | B1 | 9/2010 | Larios | |
| 7,908,688 | B2 | 3/2011 | Tompkins | |
| 7,914,611 | B2 | 3/2011 | Vrzalik et al. | |
| 7,922,461 | B2 | 4/2011 | Wang | |
| 7,950,084 | B1 | 5/2011 | Mckay et al. | |
| 7,966,680 | B2 * | 6/2011 | Romano et al. | 5/713 |
| RE42,559 | E | 7/2011 | Wang | |
| 7,975,330 | B2 | 7/2011 | Receveur et al. | |
| 8,025,964 | B2 | 9/2011 | Landvik et al. | |
| 8,034,445 | B2 | 10/2011 | Landvik et al. | |
| 8,104,125 | B2 | 1/2012 | Soltani et al. | |
| 8,108,957 | B2 * | 2/2012 | Richards et al. | 5/600 |
| 8,151,391 | B2 * | 4/2012 | Frias | 5/710 |
| 8,220,090 | B2 | 7/2012 | Gowda | |
| 8,234,727 | B2 | 8/2012 | Schreiber et al. | |
| 8,261,387 | B2 * | 9/2012 | Lipman et al. | 5/709 |
| 8,286,282 | B2 | 10/2012 | Kummer et al. | |
| 8,332,979 | B2 | 12/2012 | Flick et al. | |
| 8,881,328 | B2 | 11/2014 | Mikkelsen et al. | |
| 2002/0138901 | A1 * | 10/2002 | Augustine et al. | 5/423 |
| 2004/0031103 | A1 | 2/2004 | Wyatt et al. | |
| 2005/0118046 | A1 | 6/2005 | Wang | |
| 2005/0210595 | A1 | 9/2005 | Di Stasio et al. | |
| 2005/0278863 | A1 | 12/2005 | Bahash et al. | |
| 2006/0288491 | A1 | 12/2006 | Mikkelsen et al. | |
| 2007/0044241 | A1 * | 3/2007 | Clark | 5/655.9 |
| 2007/0271705 | A1 | 11/2007 | Woolfson et al. | |
| 2008/0250568 | A1 | 10/2008 | Wu | |
| 2009/0056030 | A1 | 3/2009 | Bolden | |
| 2009/0144903 | A1 | 6/2009 | Delvaux et al. | |
| 2009/0165213 | A1 | 7/2009 | Collins et al. | |
| 2009/0217458 | A1 | 9/2009 | Lord | |
| 2010/0170044 | A1 | 7/2010 | Kao et al. | |
| 2011/0010855 | A1 | 1/2011 | Flessate | |
| 2011/0035880 | A1 * | 2/2011 | Cole et al. | 5/423 |
| 2011/0047710 | A1 | 3/2011 | Beard | |
| 2011/0067178 | A1 | 3/2011 | Lee | |
| 2011/0173758 | A1 | 7/2011 | Fontaine | |
| 2011/0247143 | A1 | 10/2011 | Richards et al. | |
| 2011/0289685 | A1 | 12/2011 | Romano et al. | |
| 2011/0308020 | A1 | 12/2011 | Vrzalik et al. | |
| 2011/0314607 | A1 | 12/2011 | Woolfson et al. | |
| 2012/0017376 | A1 | 1/2012 | Mikkelsen et al. | |
| 2012/0065560 | A1 | 3/2012 | Siegner | |
| 2012/0110734 | A1 | 5/2012 | An | |
| 2012/0167303 | A1 | 7/2012 | Stroh et al. | |
| 2012/0233773 | A1 | 9/2012 | Suzuki | |
| 2012/0304381 | A1 | 12/2012 | Paterok | |
| 2013/0026065 | A1 | 1/2013 | Koseoglu | |
| 2013/0042414 | A1 | 2/2013 | Schreiber et al. | |
| 2013/0074272 | A1 * | 3/2013 | Lachenbruch et al. | 5/691 |
| 2013/0104312 | A1 | 5/2013 | O'Reagan | |
| 2013/0205506 | A1 | 8/2013 | Lachenbruch et al. | |
| 2013/0212808 | A1 | 8/2013 | Lachenbruch et al. | |

FOREIGN PATENT DOCUMENTS

| | | | |
|---|---|---|---|
| EP | 2526836 | A1 | 11/2012 |
| JP | 2004-242797 | A | 9/2004 |
| JP | 2010-057750 | A | 3/2010 |

OTHER PUBLICATIONS

Office Action issued Nov. 20, 2014 in U.S. Appl. No. 14/042,948.
Office Action issued Sep. 16, 2014 in U.S. Appl. No. 14/042,948.
Extended European Search Report issued Oct. 14, 2014 in EP Application No. 13197319.0.
Office Action issued Mar. 19, 2015 in CA Application No. 2,835,678.
Office Action issued Nov. 19, 2015 in EP Application No. 13818885.9.

* cited by examiner

BODY SUPPORT SYSTEM WITH COMBINATION OF PRESSURE REDISTRIBUTION AND INTERNAL AIR FLOW GUIDE(S) FOR WITHDRAWING HEAT AND MOISTURE AWAY FROM BODY RECLINING ON SUPPORT SURFACE OF BODY SUPPORT SYSTEM

BACKGROUND

1. Field of the Invention

The field of the present invention relates to body support systems that include elements for pressure redistribution and which include one or more internal air flow guides. The system also establishes pathways for drawing heat and moisture away from surface(s) contacting and supporting a reclining body on the body support system.

2. Background

Those that care for persons confined to beds and wheelchairs understand the role body support systems play with respect to the prevention and treatment of pressure ulcers. Pressure ulcers, which are also known as bedsores, pressure sores, and decubitus ulcers, rapidly develop when prolonged pressure, heat, and moisture are applied to the skin. Persons at risk of developing pressure ulcers commonly are those who have one or more medical conditions that render them fully or partially immobile. Their inability to move, or to change positions more frequently when reclining or seated, causes an uncomfortable distribution of pressure applied against the skin that can directly lead to the development of pressure ulcers.

As uncomfortable distribution of pressure is applied against the skin, blood vessels become pinched, which in turn decreases blood supply at sites where pressure is applied. Heat, resulting from friction, rising body temperature, etc., also decreases blood supply at sites where the pressure is applied. And moisture from incontinence, perspiration, and exudate at these sites further exacerbates the skin, first causing bonds between epithelial layers to weaken, and thereafter causing skin maceration. Failure to address prolonged instances of pressure, heat, and moisture also can cause pressure ulcers to become sites that breed infection. These infection sites often lead to illness, and in severe cases—death.

Considering the severe consequences if pressure ulcers are not effectively treated, the ability of body support systems to relieve pressure from building up against the body and to affect heat and moisture levels at support surfaces is critical. Sufficient measures to prevent and treat pressure ulcers should, therefore, include the selection of body support systems that can redistribute pressure, withdraw heat, and draw away or evaporate moisture from support surfaces. Systems that redistribute pressure frequently are classified as either dynamic or static. Dynamic systems are driven, using an external source of energy (typically direct or alternating electrical current) to alter the level of pressure by controlling inflation and deflation of air cells within the system or the movement of air throughout the system. In contrast, static systems maintain a constant level of air pressure and redistribute pressure through use of materials that conform to body contours of the individual sitting or reclining thereon. Quantitative measurement of two parameters—Heat Withdrawal Capacity and Evaporative Capacity—also may be used to indicate a support surface's ability to withdraw heat and evaporate moisture.

Although foam is frequently used in both static and dynamic body support systems, few, if any, systems incorporate foam to redistribute pressure, withdraw heat, and draw away or evaporate moisture buildup at foam support surfaces. While foam has been incorporated into some body support systems to affect moisture and heat, most of these systems merely incorporate openings or profiles in foam support layers to provide air flow paths. In addition, few, if any, systems specify use of internal air flow guides with specific parameters related to heat withdrawal and moisture evaporation (i.e. Heat Withdrawal Capacity and Evaporative Capacity) at foam support surfaces. Hence, improvements continue to be sought.

SUMMARY

Various configurations of body support system are described herein. Each type of support system includes at least one uppermost comfort layer with a support surface, a central core, and a bottommost foundation layer. In preferred embodiments, the uppermost comfort layer is manufactured from a temperature and pressure sensitive cellular polymer material such as viscoelastic open cell polyurethane foam. Positioned below the uppermost comfort layer is a central core that includes multiple elements for pressure redistribution and control of air flow and/or moisture vapor throughout the system. Disposed within the central core are one or more air flow guides that form an air flow path within the core of the body support system for air and/or moisture vapor transport. These air flow guides are preferably manufactured from a low air loss material such as reticulated open cell polyurethane foam.

A more complete understanding of various configurations of the body support systems disclosed herein will be afforded to those skilled in the art, as well as a realization of additional advantages and objects thereof, by consideration of the following detailed description. Reference will be made to the appended sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION

Figure 1:
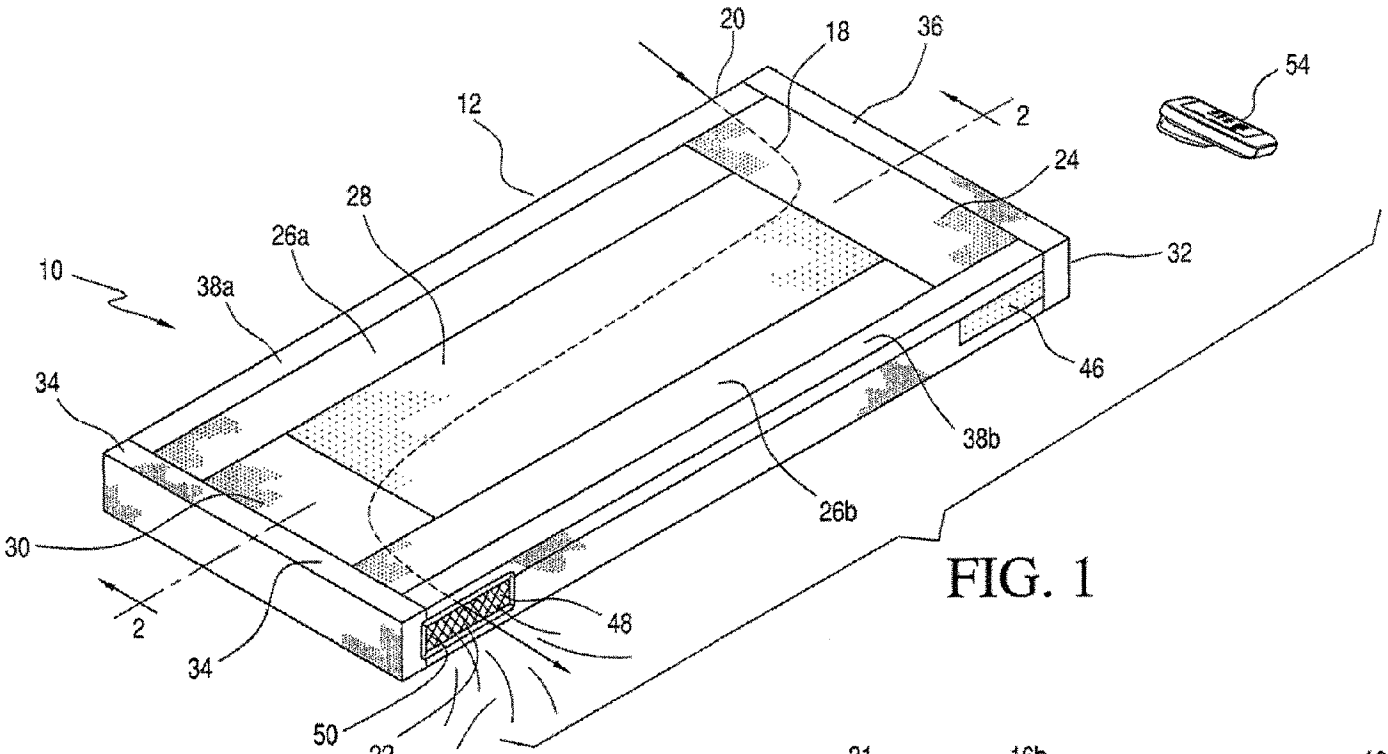
FIG. 1 is a right front perspective view of a first configuration of a body support system.

FIGS. 1-11B show various configurations of body support systems 10, 100, 200 for pressure redistribution for a body of an individual reclining or sitting on such body support systems. The body support systems include structure to withdraw heat and withdraw or evaporate moisture away from the individual reclining or sitting on the body support system. Therefore, the system configurations shown in the figures include a number of elements that aid in prevention and treatment of pressure ulcers. As used herein the term "body support system" includes mattresses, pillows, seats, overlays, toppers, and other cushioning devices, used alone or in combination to support one or more body parts. Also as used herein, the term "pressure redistribution" refers to the ability of a body support system to distribute load over areas where a body and support surface contact. Body support systems and the elements or structures used within such systems may be characterized by several properties. These properties include, but are not limited to, density (mass per unit volume), indentation force deflection, porosity (pores per inch), air permeability, Heat Withdrawal Capacity, and Evaporative Capacity.

Indentation Force Deflection (hereinafter "IFD") is a measure of foam stiffness and is frequently reported in pounds of force (lbf). This parameter represents the force exerted when foam is compressed by 25% with a compression platen. One procedure for measuring IFD is set forth in ASTM D3574. According to this procedure, for $IFD_{25}$ at 25%, foam is compressed by 25% of its original height and the force is reported after one minute. Foam samples are cut to a size of 15"×15"× 4" prior to testing.

Air permeability for foam samples typically is measured and reported in cubic feet per square foot per minute ($ft^3/ft^2/min$). One method of measuring air permeability is set forth in ASTM 737. According to this method, air permeability is measured using a Frazier Differential Pressure Air Permeability Pressure machine. Higher values measured, using this type of machine, translate to less resistance to air flow through the foam.

"Heat Withdrawal Capacity" refers to the ability to draw away heat from a support surface upon direct or indirect contact with skin. "Evaporative Capacity" refers to the ability to draw away moisture from a support surface or evaporate moisture at the support surface. Both of these parameters, therefore, concern capability to prevent excessive buildup of heat and/or moisture at one or more support surfaces. The interface where a body and support surface meet may also be referred to as a microclimate management site, where the term "microclimate" is defined as both the temperature and humidity where a body part and the support surface are in contact (i.e. the body-support surface interface). Preferably, the measurement and calculation of Heat Withdrawal Capacity and Evaporative Capacity are conducted according to standards issued by the Rehabilitation Engineering and Assistive Technology Society of North America ("RESNA").

Figure 2:
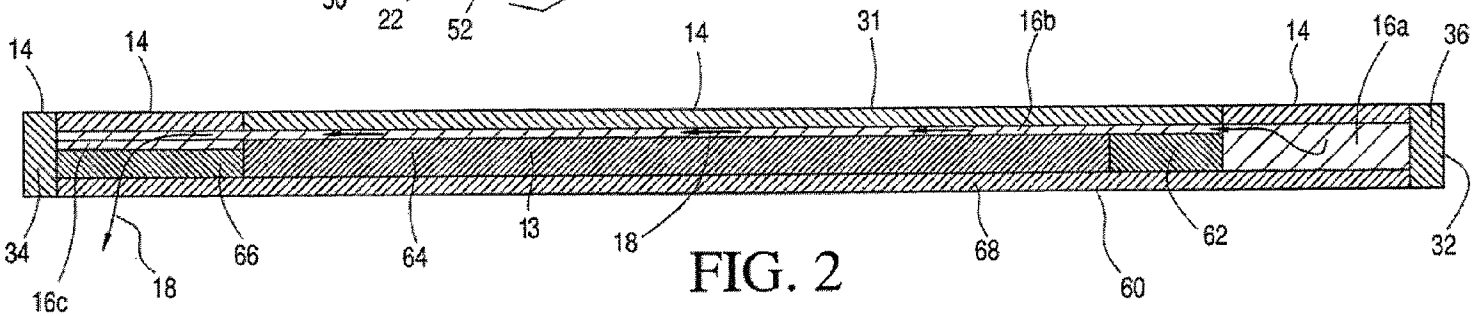
FIG. 2 is a cross-sectional view of the body support system shown in FIG. 1, taken along line 2-2 in FIG. 1.
Figure 3:
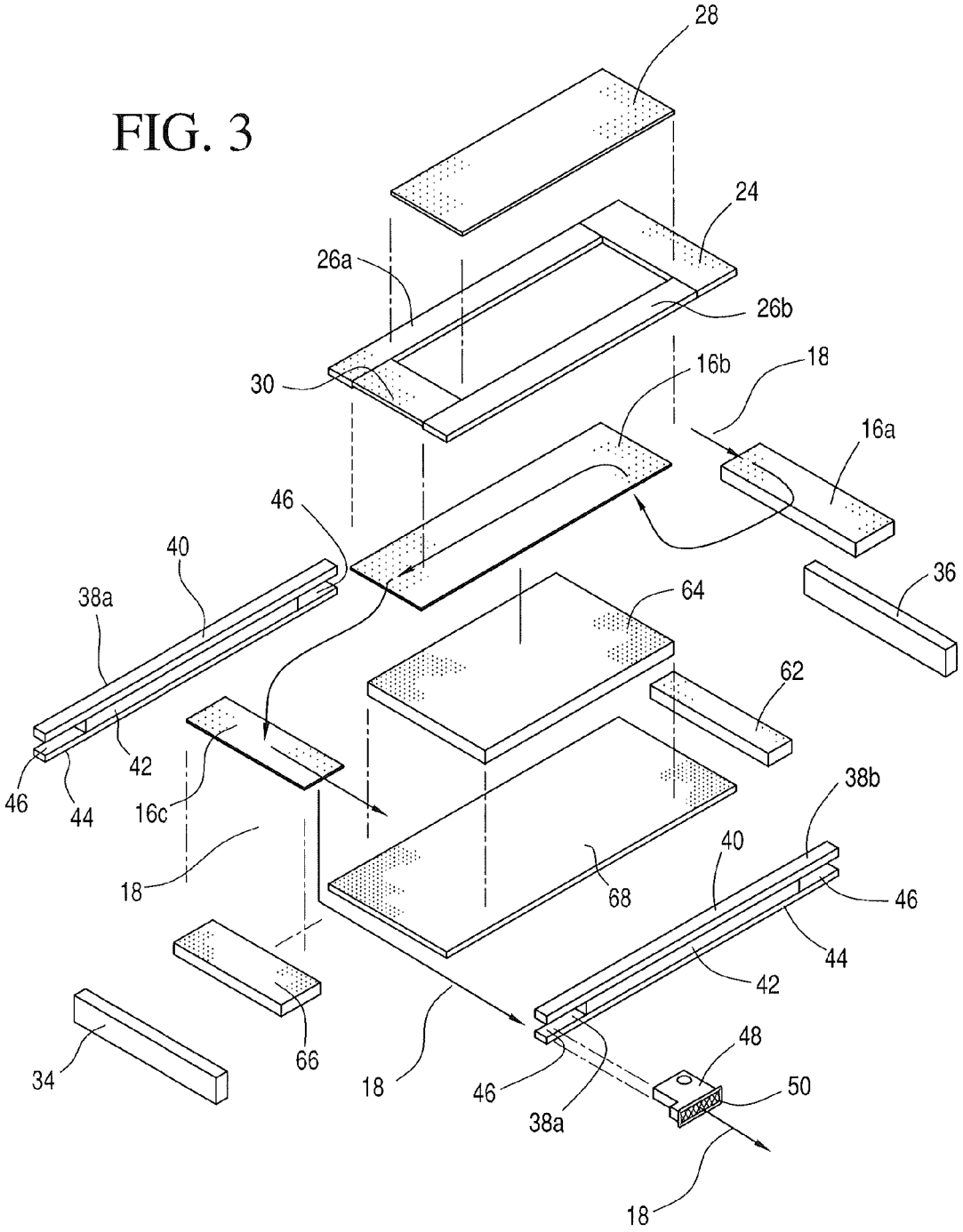
FIG. 3 is an exploded view of the body support system shown in FIG. 1.

Turning in detail to the drawings, FIGS. 1-3 show a first configuration of a body support system 10. The system 10 may be assembled for use as a mattress, which in this example is particularly suited for medical environments that care for long-term care patients with limited mobility. Mattresses used in these types of environments, typically have a maximum overall thickness of about 6 (six) inches. The body support system 10 in this example comprises layers in stacked relation to support an individual person or patient. The configuration and orientation of these layers is described herein.

The body support system 10 includes a plurality of uppermost comfort layers 12, with each layer having a foam support surface 14. The foam support surface 14 forms an upper or top surface of the body support system. Each foam support surface 14 comes into direct or indirect contact with a body of an individual person or patient (not shown) when the body is in a partial or full seated or lying position. In this system configuration, the plurality of uppermost comfort layers 12 are coupled to internal air flow guides 16 (FIGS. 2 and 3) to form an air flow path 18 from an air inlet 20 to an air outlet 22. Preferably, the air inlet 20 and air outlet 22 are disposed within the body support system 10 in a central core 13 positioned below, and adjacent to, the uppermost comfort layers 12 for the embodiment shown in FIGS. 1-3. The central core 13 is an area positioned between the uppermost comfort layer 12 and a bottommost layer of the body support system. By forming the air flow path 18 within the core of the body support system, air and moisture may be drawn away from one or more foam support surfaces, as further described in the Examples below.

The uppermost comfort layers 12 may be formed of a cellular polymer, such as an open cell polyurethane foam. The uppermost comfort layers 12 preferably are manufactured from materials having a temperature and pressure sensitive cellular polymer structure. Such structures include viscoelastic open cell polyurethane foams that optionally are reticulated. Viscoelastic open cell polyurethane foams have the ability conform to body contours when subjected to compression from an applied load and then slowly return to their original uncompressed state, or close to their uncompressed state, after removal of the applied load. One definition of viscoelastic foam is derived by a dynamic mechanical analysis that measures the glass transition temperature (Tg) of the foam. Nonviscoelastic resilient polyurethane foams, based on a 3000 molecular weight polyether triol, generally have glass transition temperatures below −30° C., and possibly even below −50° C. By contrast, viscoelastic polyurethane foams have glass transition temperatures above −20° C. If the foam has a glass transition temperature above 0° C., or closer to room temperature (e.g., room temperature (20° C.)), the foam will manifest more viscoelastic character (i.e., slower recovery from compression) if other parameters are held constant.

In addition, in some configurations, at least a portion of an uppermost comfort layer is reticulated. Reticulated polyurethane foam materials include those materials manufactured using methods that remove or break cell windows. Various mechanical, chemical and thermal methods for reticulating foams are known. For example, in a thermal method, foam may be reticulated by melting or rupturing the windows with a high temperature flame front or explosion, which still leaves the strand network intact. Alternatively, in a chemical method the cell windows may be etched away using the hydrolyzing action of water in the presence of an alkali metal hydroxide. If a polyester polyurethane foam has been made, such foam may be chemically reticulated to remove cell windows by immersing a foam slab in a heated caustic bath for from three to fifteen minutes. One possible caustic bath is a sodium hydroxide solution (from 5.0 to 10.0 percent, preferably 7.5% NaOH) that is heated to from 70° F. to 160° F. (21° C. to 71° C.), preferably from 120° F. to 160° F. (49° C. to 71° C.). The caustic solution etches away at least a portion of the cell windows within the foam cellular structure, leaving behind hydrophilic ester polyurethane foam.

Materials used for the uppermost comfort layers may be classified as low air loss materials. Materials of this type are capable of providing air flow to a support surface for management of heat and humidity at one or more microclimate sites.

In the body support system 10 shown in FIGS. 1-3, the plurality of uppermost comfort layers 12 includes a head and neck supporting comfort layer 24, side comfort layers 26*a*, 26*b*, a central torso supporting comfort layer 28, and a heel supporting comfort layer 30. Each of these respective layers is positioned within the body support system 10 for support of a body in a supine position. The head and neck supporting comfort layer 24 is positioned within the system 10 for support of a head and neck. The side comfort layers 26*a*, 26*b* are positioned within the system for support of upper extremities (i.e., arms). The central torso supporting comfort layer 28 is positioned within the system for support of the upper and lower torso. And, the heel supporting comfort layer 30 is positioned within the system 10 for support of the lower extremities (i.e., feet and ankles). Each respective comfort layer has a density ranging from about 1.5 pounds per cubic foot (lb/ft$^3$) to about 8.0 lb/ft$^3$, and preferably from about 3.0 lb/ft$^3$ to about 5.0 lb/ft$^3$. In addition, each respective comfort layer has an $IFD_{25}$ ranging from about 5 pounds-force (lbf) to about 20 lbf, and preferably from about 8 lbf to about 15 lbf.

In addition to the properties referred to above, the central torso supporting comfort layer 28 also may have a substantially porous and air permeable structure. In preferred embodiments, the central comfort layer has a porosity ranging from about 65 pores per inch (ppi) to about 75 ppi and air permeability values ranging from about 150 cubic feet per square foot per minute (ft$^3$/ft$^2$/min) to 350 ft$^3$/ft$^2$/min. Because the central comfort layer 28 includes a central uppermost foam surface 31 that contacts heavier body parts, e.g., buttocks, hips, thighs, which are very susceptible pressure ulcer formation, increased porosity and air permeability in these areas can be beneficial. The increased porosity and air permeability further allows for added control of Heat Withdrawal Capacity and Evaporative Capacity, as further described below.

Adjacent to the plurality of uppermost comfort layers 12 is a plurality of foam surrounds or rails 32. The foam surrounds or rails 32 generally are firmer than other portions of the construction to support an individual when sitting at the side or end of the mattress. The plurality of foam surrounds or rails 32 includes a foot rail 34, a head rail 36, a left side rail 38*a* and right side rails 38*b*. As shown in FIG. 3, the left and right side rails 38*a*, 38*b* may each include an upper side rail 40, a middle side rail 42, and a lower side rail 44, which are joined together or adhered to each other. Defined within each left and right side rail 38*a*, 38*b* are cavities 46 for insertion of one or more air flow units 48. Alternatively, the left and right side rails 38*a*, 38*b* may be formed as one-piece structures into which cavities 46 are defined within the side rails for receiving the air flow units 48. Each rail 32 included in the plurality of foam surrounds or rails has a density ranging from about 1.0 lb/ft$^3$ to about 3.0 lb/ft$^3$, and preferably from about 2.4 lb/ft$^3$ to about 2.8 lb/ft$^3$. In addition, each respective foam surround or rail has an $IFD_{25}$ ranging from about 5 lbf to about 250 lbf and preferably from about 50 lbf to about 70 lbf.

One or more air flow units 48 are disposed within the body support system 10 to facilitate air flow along one or more air flow paths 18, depending upon the positioning of air inlets and air outlets within the system 10. Both air inlets and air outlets may be defined in one or more cavities 46 positioned within the system. Air flow units 48 may be configured to generate air flow using either positive or negative pressure. One type of suitable air flow unit is a 12V DC Blower sold by Delta Electronics. The use of air flow units 48 facilitates withdrawal from and removal of moisture and heat at foam support surfaces 14 for control of both Heat Withdrawal Capacity and Evaporative Capacity of one or more foam support surfaces of the body support system 10.

As shown in FIGS. 1-3, one air flow unit 48 is disposed within the system 10 and seats within an internal portion of the body support system 10. However, in other system configurations, one or more air flow units may be either internal or external to the system, and if external to the system, include one or more connecting members (not shown) such as tubing or piping. In alternative system configurations one or more air flow units also may be mounted in an accessible location near or adjacent the system. Suitable locations include, but are not limited to, portions of a bedframe, such as a drawer, support leg, headboard, footboard, or cabinets, or shelving coupled to the body support system.

An air flow unit 48 may include a screen 50 coupled to a filter (not shown), which in combination are used to filter particles, spores, bacteria, etc., which would otherwise exit the body support system 10 into the room air through air flow unit 48. During operation, the air flow unit 48 may operate to reduce and/or increase pressure within the system to facilitate air flow along air flow paths 18 from an air inlet 20 to an air outlet 22. Regardless of the placement of an air flow unit 48 within the system, it should be configured to exhaust air 52 to the surrounding environment, as particularly shown in FIG. 1.

Optionally, a pillow or plug (not shown) may fill any cavity 46 of the body support system 10 when the air flow unit 48 is removed and the body supporting system is used in a static condition (i.e., without air flow through the core of the body support system).

The body support system 10 may be encased in a protective, waterproof, moisture vapor permeable cover (not shown), such as fabric laminate constructions incorporating polyurethane coatings or expanded polytetrafluoroethylene (ePTFE) When in use, the body support system 10 may be covered by a textile bedding sheet (not shown).

A wireless controller 54 also may be used to control various aspects of the system 10. For example, a wireless controller may control the level and frequency, rate, duration, and amplitude of air flow and pressure that travels through the system. A wireless controller also may include one or more alarms to alert a patient or caregiver of excessive use of pressurized air, synchronization issues and power failure at surface power unit. In addition, a wireless controller also may be used to vary positioning of the body support system if the system is so configured to fold or bend Referring particularly to FIGS. 2 and 3, air flow paths 18 are further facilitated by the arrangement of an internal air flow guide 16 within the system 10. The internal air flow guide 16 facilitates air flow from the air inlet 20 to the air outlet 22. The internal air flow guide 16 can include multiple portions or be manufactured from a singular piece of air permeable material. Where multiple portions are used, each respective piece of air permeable material is coupled either to a comfort layer, or to an air inlet, or to an air outlet, such that the entire internal air flow guide 16 forms a discrete pathway to direct air and/or moisture vapor flow through the internal core of the body support system 10.

As an example of a multiple portion internal air flow guide, the internal air flow guide 16 may include an upper body portion 16*a*, a central body portion 16*b*, and a lower body portion 16*c*, as shown particularly in FIG. 2. Each of these respective portions 16*a*, 16*b*, 16*c* are positioned within the body support system 10 at locations corresponding to the locations that support a person's upper body (e.g., head and neck), central body (e.g., upper and lower torso), and lower body (e.g., lower extremities), respectively. Where multiple air flow guides are disposed within the system 10, the upper body portion 16*a* may be adjacent to the central body portion (FIG. 2) or positioned vertically higher relative to the lower body portion 16*c*. In addition, the central body portion 16*b* may be positioned vertically higher relative to the lower body portion 16*c*. As such, the arrangement of the multiple portion internal air flow guides, as shown in the FIGS. 1-3, is not to be construed as limiting. However, one or more internal air flow guides, preferably are positioned within the body support system 10 to fulfill competing functions of pressure redistribution, moisture withdrawal/evaporation and heat withdrawal from the one or more foam support surfaces 14.

Materials used to manufacture an internal air flow guide, therefore, have physical properties that relieve pressure and facilitate air flow. Preferably, the internal air flow guide(s) comprise open cell polyurethane foams that have been reticulated. Singular or multiple internal air flow guides formed from cellular polymer material(s) preferably have a foam density of ranging from about 1.3 lb/ft$^3$ to about 2.5 lb/ft$^3$, and preferably from about 1.6 lb/ft$^3$ to about 2.2 lb/ft$^3$. In addition, each respective air flow guide formed from cellular polymer material(s) has an IFD ranging from about 10 lbf to about 80 lbf, and preferably from about 25 lbf to about 40 lbf. Porosity of singular or multiple internal air flow guides formed from cellular polymer material(s) preferably ranges from about 10 ppi to about 30 ppi.

The body support system 10 also includes a plurality of additional support layers 60 positioned under the internal air flow guide 16 for further support of a body in a supine position. The plurality of support layers 60 includes an upper support layer 62, a central support layer 64, a lower support layer 66, and a foundation support layer 68. Support layers 62, 66, 68 may be formed from open cell polyurethane foam having a density ranging from about 1.0 lb/ft$^3$ to about 3.0 lb/ft$^3$, and preferably from about 2.4 lb/ft$^3$ to about 2.8 lb/ft$^3$. In addition, each support layer 62, 66, 68 of cellular polymer material has an $IFD_{25}$ ranging from about 5 lbf to about 250 lbf and preferably from about 50 lbf to about 70 lbf. The lower support layer 66 is preferably "soft" or "softer", such that placement of a foot is particularly comfortable when the body is in a fully supine position. As such, preferably, the density of cellular polymer material forming the lower support layer 66 ranges from about 1.0 lb/ft$^3$ to about 1.3 lb/ft$^3$ and the $IFD_{25}$ of the cellular polymer material forming the lower support layer 66 ranges from about 10 lbf to about 20 lbf. Support layer 64 may be formed from open cell polyurethane foam having a density ranging from about 1.0 lb/ft$^3$ to about 3.0 lb/ft$^3$, and preferably from about 1.4 lb/ft$^3$ to about 2.0 lb/ft$^3$. In addition, the central support layer 64 of cellular polymer material preferably has an $IFD_{25}$ ranging from about 5 lbf to about 250 lbf and preferably from about 30 lbf to about 40 lbf.

FIGS. 4-7 show a second configuration of a body support system 100. The system 100 may be assembled for use as a mattress, which is particularly suited for home environments of those with limited mobility, e.g., elderly and disabled persons who are susceptible to pressure ulcers. This system configuration is further designed as a multi-zone system, which is suited to support two reclining bodies (not shown) that lay longitudinally along the length of the system in fully or partially supine positions. Support surfaces in multi-zoned systems, such as that shown in FIGS. 4-7, include a plurality of segments that have different pressure redistribution capabilities.

Figure 4:
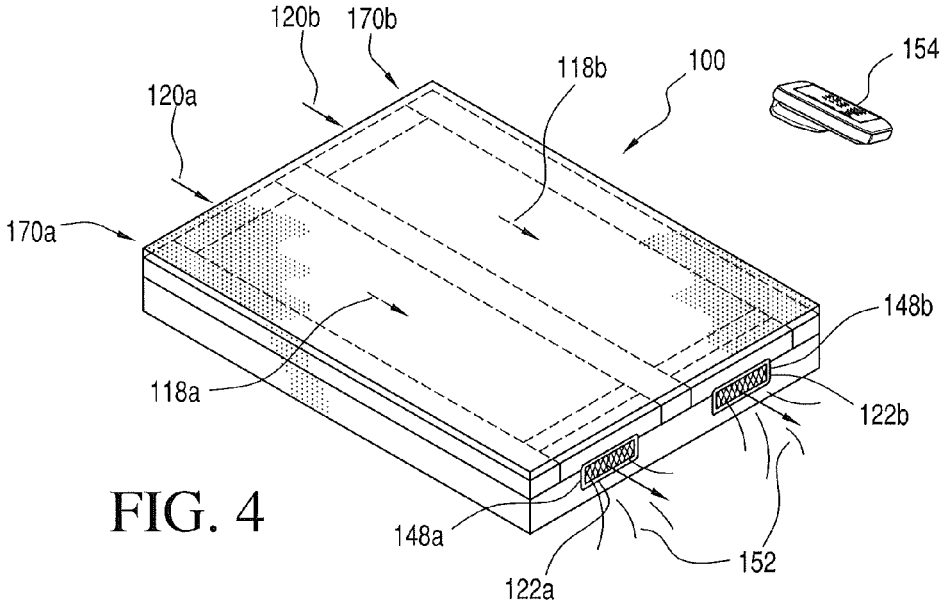
FIG. 4 is a right front perspective view of a second configuration of a body support system.
Figure 5:
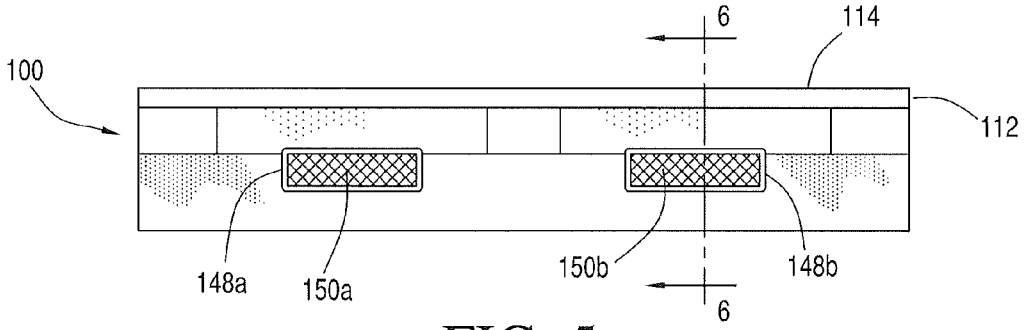
FIG. 5 is a front view of the body support system shown in FIG. 4.

As shown particularly in FIGS. 4 and 5, the body support system 100 defines a left-side zone 170*a* and a right-side zone 170*b*. These zones are respectively arranged within the system 100 and coupled to internal air flow guides 116*a*, to form an air flow paths 118*a*, 118*b* from air inlets 120*a*, 120*b* to air outlets 122*a*, 122*b*. Preferably, the air inlets 120 and air outlets 122 are disposed within cavities formed in the body support system 100. By forming the air flow paths 118*a*, 118*b*, the system 100 is able to withdraw heat and withdraw or evaporate moisture away from the foam support surface 114. The material forming the air flow paths 118*a*, 118*b* preferably also has body-supporting characteristics that contribute to the pressure redistribution function of the body support system 100. To fulfill these competing functions, the body support system 100 includes an uppermost comfort layer 112, a central core 113 and a foundation 190. The central core 113 is defined as the area between the uppermost comfort layer 112 and the bottommost layer, i.e. the foundation 190. Included within the central core 113 are the internal comfort layers 180*a*, 180*b*, internal air flow guides 116*a*, 116*b*, upper air flow blocks 182*a*, 182*b*, lower air flow block 184*a*, 184*b*, inner support blocks 186*a*, 186*b*, external support blocks 188*a*, 188*b*, and a foundation 190.

The uppermost comfort layer 112 and the internal comfort layers 180*a*, 180*b* are preferably manufactured from the same material, such as a cellular polymer. For example, each respective comfort layer may be manufactured from materials having a temperature and pressure sensitive cellular polymer structure, including viscoelastic open cell polyurethane foams, reticulated polyurethane foams, and low air loss materials. Such cellular polymer materials preferably have a density ranging from about 1.5 lb/ft$^3$ to about 8.0 lb/ft$^3$, and preferably from about 3.0 lb/ft$^3$ to about 5.0 lb/ft$^3$. In addition, the comfort layer has an $IFD_{25}$ ranging from about 5 lbf to about 20 lbf and preferably from about 8 lbf to about 15 lbf. In addition, each comfort layer also may be reticulated, such that it has a substantially porous and air permeable structure with a porosity ranging from about 65 pores per inch to about 30 pores per inch and air permeability values ranging from about 5 cubic feet per square foot per minute (ft$^3$/ft$^2$/min) to 1000 ft$^3$/ft$^2$/min.

The internal air flow guides 116*a*, 116*b* and the air flow blocks 182*a*, 182*b*, 184*a*, 184*b* are preferably manufactured from cellular polymer materials that facilitate air flow. One example is reticulated open cell polyurethane foam. These air flow guides and blocks when formed of cellular polymer materials preferably have a density of ranging from about 1.3 lb/ft$^3$ to about 2.5 lb/ft$^3$, and more preferably from about 1.6 lb/ft$^3$ to about 2.2 lb/ft$^3$. In addition, each respective air flow guide and block formed from cellular polymer materials has an $IFD_{25}$ ranging from about 10 lbf to about 80 lbf and preferably from about 25 lbf to about 40 lbf. Porosity of internal air flow guides and blocks formed from cellular polymer materials preferably ranges from about 10 ppi to about 30 ppi.

Figure 6:
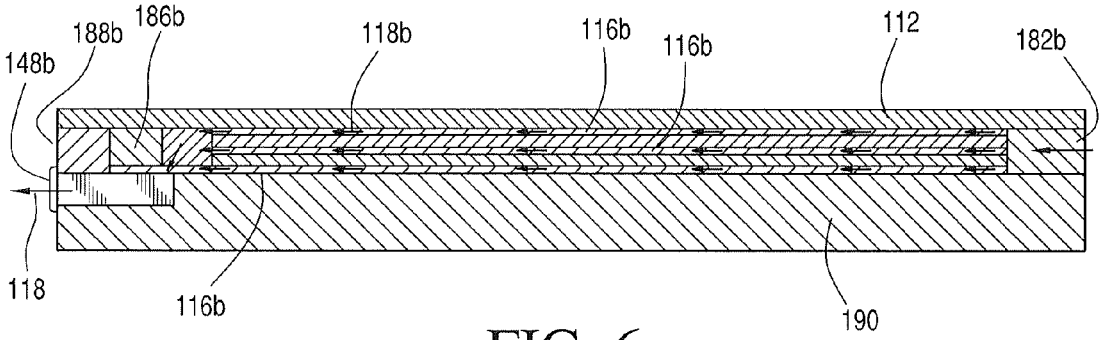
FIG. 6 is a cross-sectional view of the body support system shown in FIG. 4, taken along line 6-6 in FIG. 5.
Figure 7:
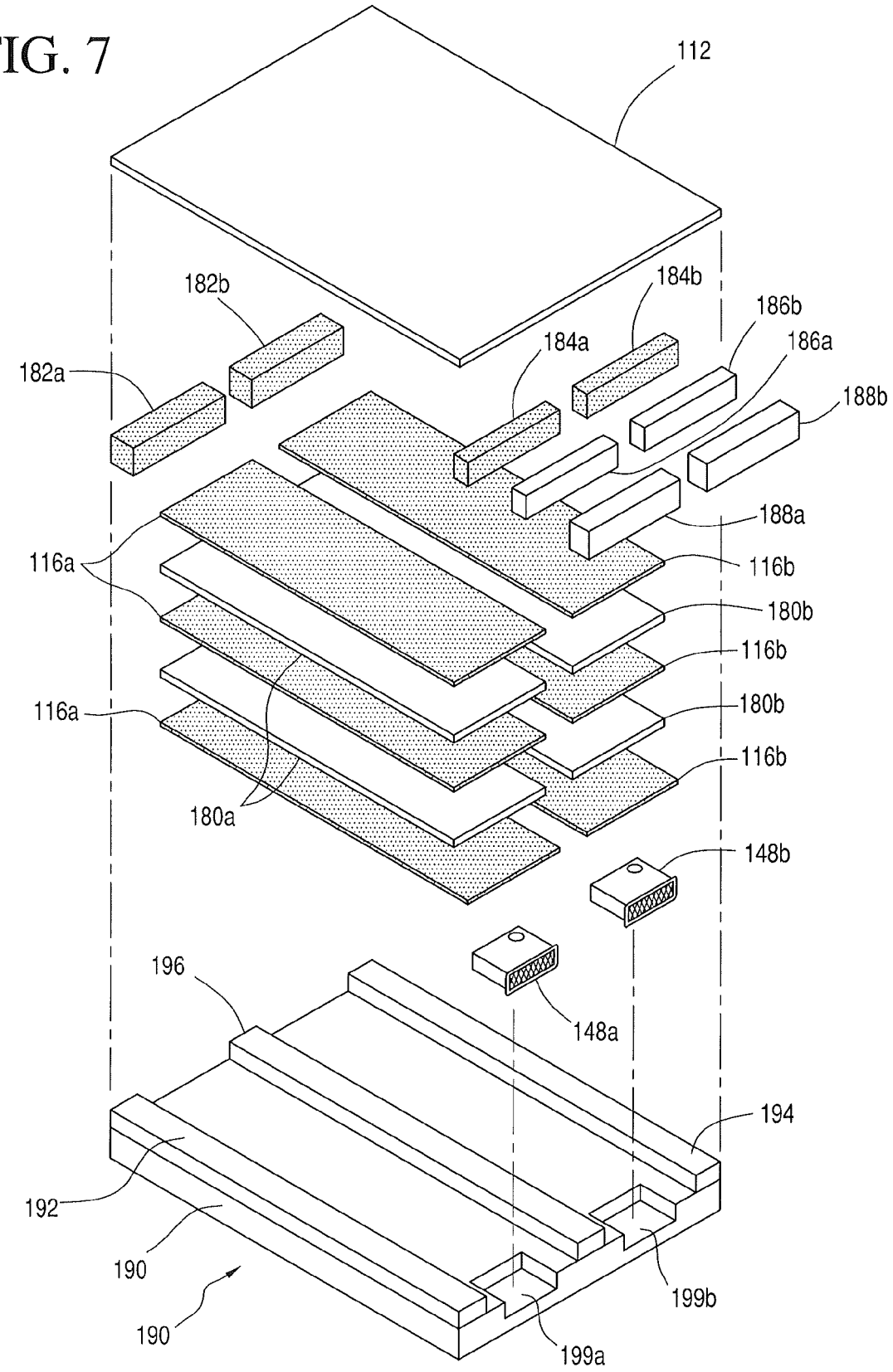
FIG. 7 is an exploded view of the body support system shown in FIG. 4.
Figure 8:
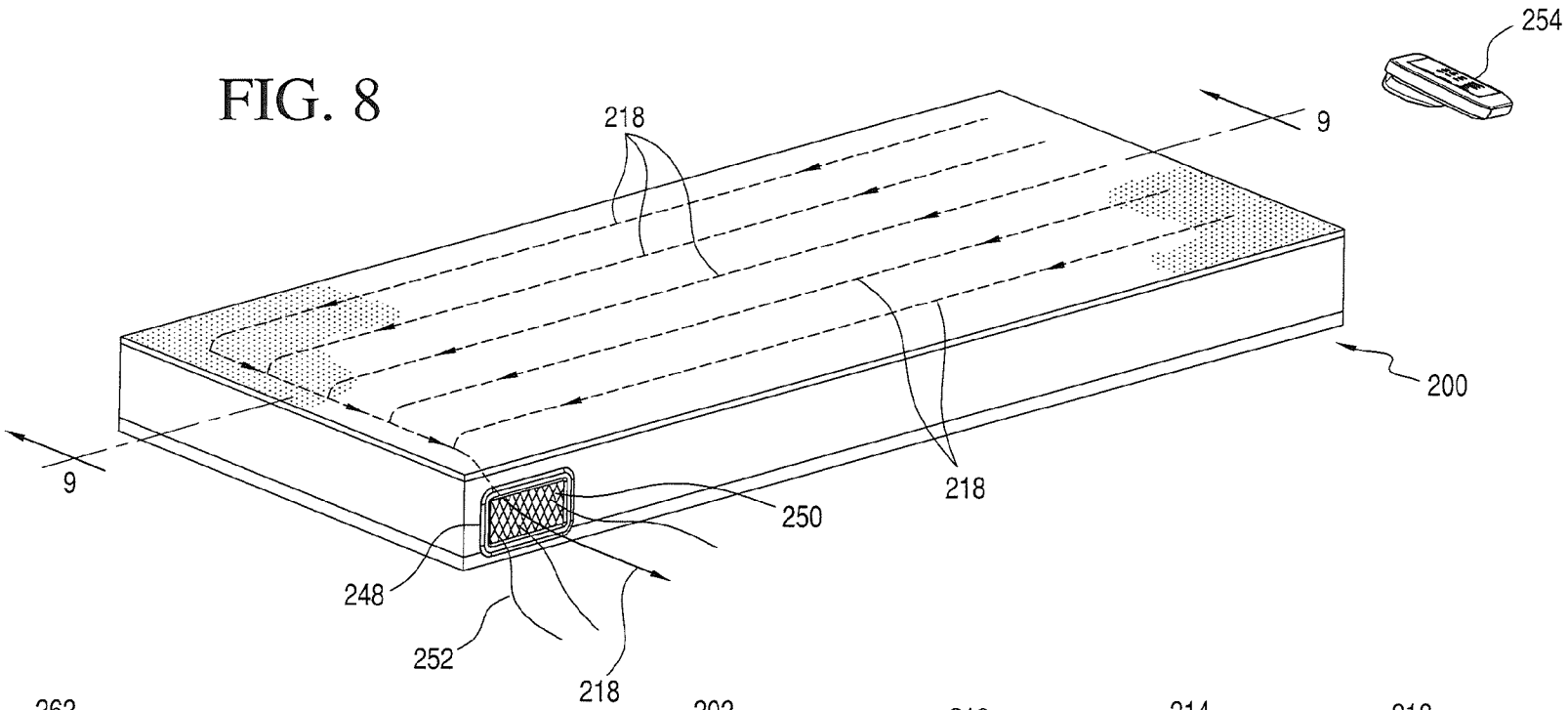
FIG. 8 is a right front perspective view of a third configuration of a body support system.
Figure 9:
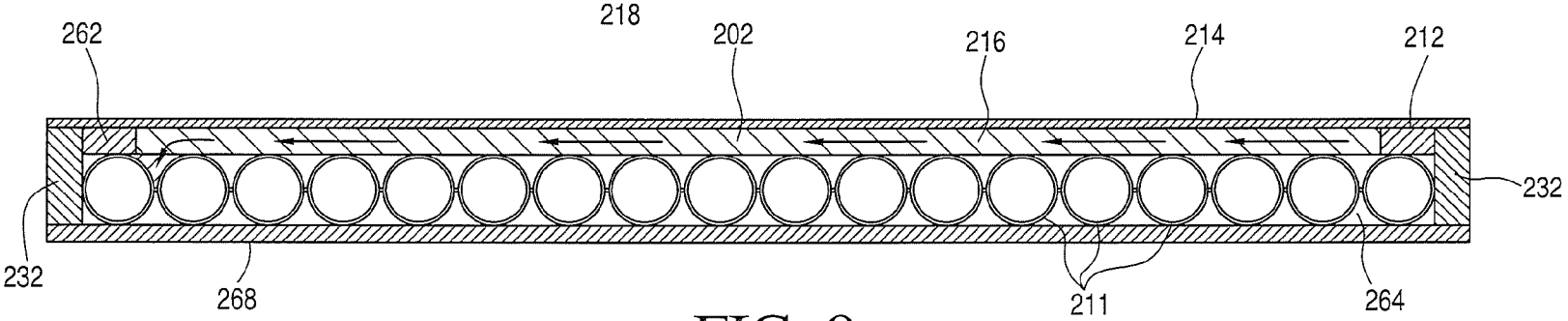
FIG. 9 is a cross-sectional view of the body support system shown in FIG. 8, taken along line 9-9 of FIG. 8.

Referring to FIGS. 6 and 7, support blocks 186*a*, 186*b*, 188*a*, 188*b* and the foundation 190 are positioned under the internal air flow guides 116*a*, 116*b* and the air flow support blocks 184*a*, 184*b*, 186*a*, 186*b* for dual-zone support of two bodies in supine positions. The foundation 190 includes two outer supports 192, 194, a medial support 196, and a bottom support layer 198. Defined within the bottom support layer are two cavities 199*a*, 199*b* for placement of air flow units 148*a*, 148*b*. These support blocks, foundation, supports and bottom support layer when formed of cellular polymer material preferably have a density ranging from about 1.0 lb/ft$^3$ to about 3.0 lb/ft$^3$, and more preferably from about 1.4 lb/ft$^3$ to about 1.8 lb/ft$^3$ and an IFD$_{25}$ ranging from about 5 lbf to about 250 lbf, and preferably from about 30 lbf to about 40 lbf.

Two air flow units 148*a*, 148*b* also are positioned within cavities 199*a*, 119*b* to facilitate air flow along one or more air flow paths 118*a*, 118*b* and exhaust air 152 to the surrounding environment. Air flow units 148*a*, 148*b* are configured to generate air flow, using either positive or negative pressure. When using negative pressure, the air flow units in combination with the air flow guides draw moisture and heat away from the foam support surface 114. In other system configurations (not shown), air flow unit 148*a*, 148*b* may be external to the system 100 and include one or more connecting members (not shown), such as tubing or piping. Alternatively, air flow units 148*a*, 148*b* may be mounted onto or in an accessible location near or adjacent the system. Each air flow unit 148 also preferably includes a screen 150*a*, 150*b* coupled to a filter (not shown) to capture particles exiting the system. A wireless controller 154 also may be used for control of various aspects of the system 100, as described with reference to the first system configuration 10.

FIGS. 8-11B show a third configuration of a body support system 200. This system configuration also may be assembled for use as a mattress, which is particularly suited for home environments of those with limited mobility, e.g., elderly and disabled persons who are susceptible to pressure ulcers. Mattresses used in these types of environments, typically have a maximum overall thickness of about 14 inches. This system configuration includes an uppermost comfort layer 212, a central core 213, and a foundation support layer 268. The central core 213 is defined as the area between the uppermost comfort layer 212 and the bottommost layer, i.e. the foundation support layer 268. As such, the central core 213 includes a plurality of fluid cells 211, a plurality of internal air flow guides 216, a surround 232, an upper support layer 262, and a central support 264. This type of system may be considered a hybrid static and dynamic system because it includes materials that conform to body contours and includes alternating pressure elements.

The body support system 200 includes a singular uppermost comfort layer 212, having a foam support surface 214 that comes into direct or indirect contact with a body (not shown) when the body is in a partially or fully seated or lying position on the body support system 200. In this system configuration, the uppermost comfort layer 212 is coupled to and positioned over internal air flow guides 216 (FIGS. 9 and 10) to form a plurality of air flow paths 218 within the system 200. An air flow unit 248 is disposed within the body support system to establish negative pressure to draw air and moisture vapor through the internal air flow guides 216 along the plurality of air flows paths 218. This type of air flow unit 248 is also configured to generate air flow and exhaust air 252 to an air outlet 222, using either positive or negative pressure. Therefore, air within the system is drawn through the plurality of internal air flow guides 216 thereby to draw moisture and heat away from the foam support surface 214.

Figure 10:
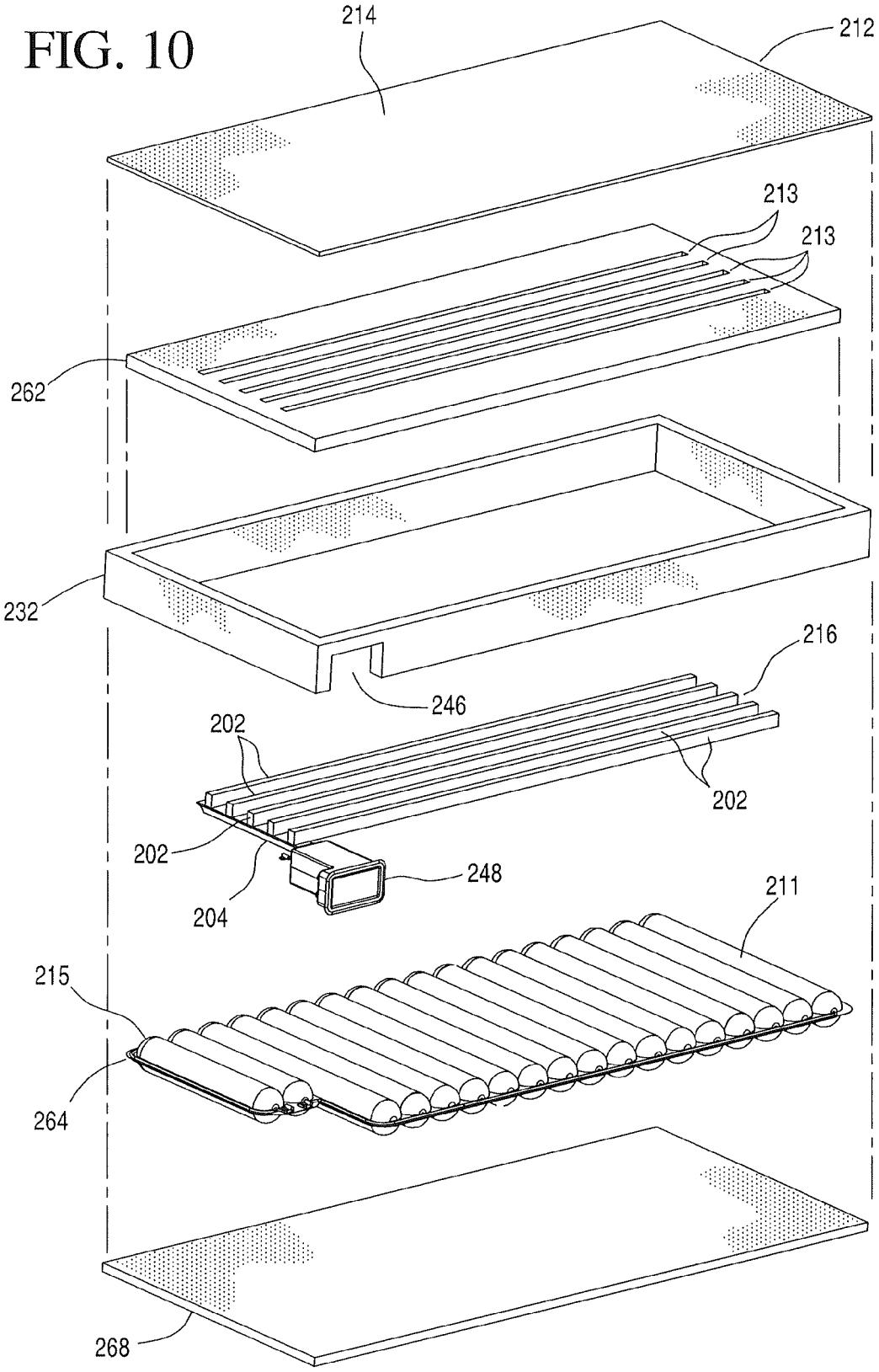
FIG. 10 is an exploded view of the body support system shown in FIG. 8.
Figure 11A:
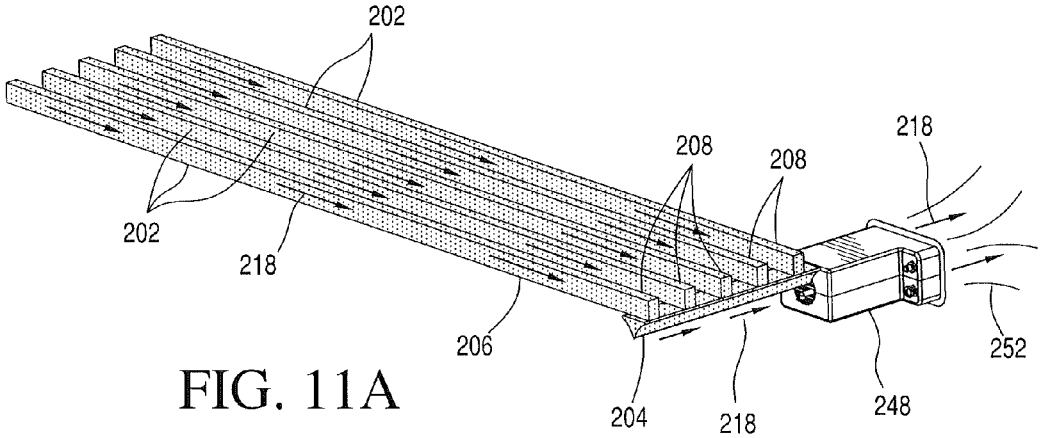
FIG. 11A is a rear perspective view of the internal air flow guides and air flow unit shown in FIG. 10.

As shown particularly in FIGS. 10 and 11A, the plurality of internal air flow guides 216 includes longitudinal air flow guides 202 and a transverse air flow guide 204. Each longitudinal air flow guide 202 extends lengthwise to correspond generally to the length of at least one body in a supine position on the body support system 200. The transverse air flow guide 204 is coupled to a bottom surface 206 at an end 208 of each longitudinal air flow guide 202, as shown in FIG. 11A. In this configuration, the transverse air flow guide 204 is positioned within a ridge 215 between two fluid cells. The materials forming the plurality of air flow guides 216 also facilitate air flow because of their physical properties. For example, a cellular polymer material such as reticulated open cell polyurethane foam may be used to form the air flow guides 216 and the transverse air flow guide 204. Each air flow guide may be formed of a cellular polymer with a density ranging from about 1.3 lb/ft$^3$ to about 2.5 lb/ft$^3$, and preferably from about 1.6 lb/ft$^3$ to about 2.2 lb/ft$^3$. In addition, each respective air flow guide may be formed of a cellular polymer with an IFD$_{25}$ ranging from about 10 lbf to about 80 lbf and preferably from about 25 lbf to about 40 lbf, and porosity ranging from about 10 ppi to about 30 ppi.

The surround 232 may be a unitary piece or separate pieces that include a foot rail, a head rail, and side rails. As shown particularly in FIG. 10, a cavity 246 may be defined within the surround 242 to accommodate an air flow unit 248 within the system 200. The surround preferably is formed of a cellular polymer material that has a density ranging from about 1.0 lb/ft$^3$ to about 3.0 lb/ft$^3$, and preferably from about 2.4 lb/ft$^3$ to about 2.8 lb/ft$^3$. In addition, each respective comfort layer may be formed of a cellular polymer material that has an IFD$_{25}$ ranging from about 5 lbf to about 250 lbf and preferably from about 50 lbf to about 70 lbf.

In the system configuration shown in FIGS. 8-11B, the central support includes cells 211 filled with fluids, such as air. The cells may be inflated or pressurized using air flow units 248 within the system, or other source(s) external to the system. Preferably, a wireless controller 254 is coupled to the system 200 to inflate and deflate cells 211 either independently, in predetermined patterns, or in unison. The wireless controller may be programmed to alternate inflation and deflation cycles. Cycling times can vary, depending upon body structures and needs of the patients, as determined by a health care professional or caregiver. Preferably, however, the cycles used vary slowly over time for user comfort.

Figure 11B:
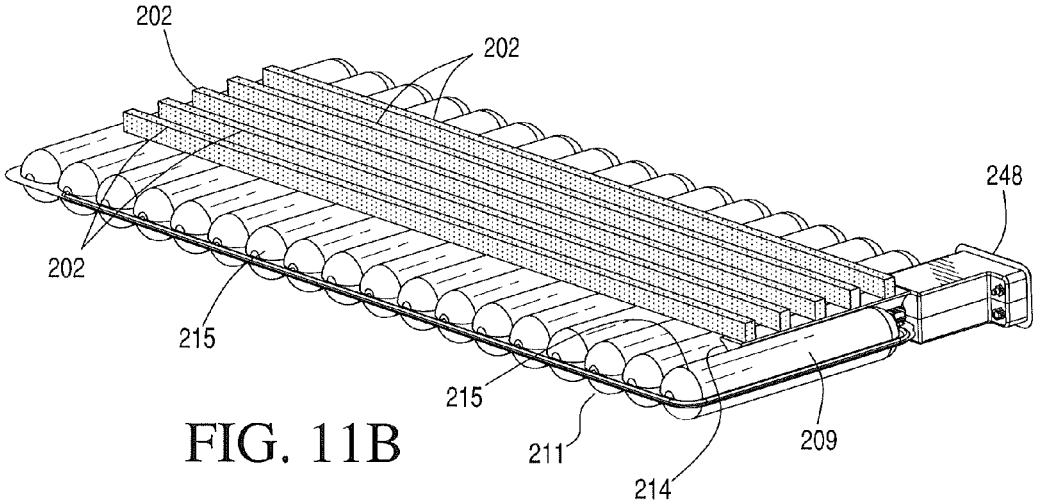
FIG. 11B is a rear perspective view of the internal air flow guides and air flow unit shown in FIG. 10 coupled to fluid cells.

As particularly shown in FIGS. 11A and 11B, in this system configuration both the plurality of cells 211 and the transverse air flow guide 204 are connected to an air flow unit 248. Thus, the air flow unit 248 is disposed within the body support system to draw air through the plurality of air flow guides 216, creating air flows paths 218, as well as to inflate and deflate cells 211, using either negative pressure (for drawing air through the air flow guides or deflating the cells) or positive pressure for inflating the cells. In this configuration, the plurality of cells 211 may include a fluid entry cell 209 and a fluid conduit 215, which are coupled to other support cells 217 for inflation and deflation. Pressure is therefore controlled through the use of both internal air flow guides and the plurality of cells 211 disposed within the system 200.

The upper support layer 262, central support layer 264, and foundation support layer 268 are positioned within the system 200 for further support of a body in a supine position. Defined within the upper support layer 262 are channels 213 used to align the longitudinal air flow guides 202 such that the guides 202 are coupled to the uppermost comfort layer 212 (FIG. 9) upon assembly. The upper support layer 262 and other comfort layers in the construction are formed of a viscoelastic cellular polymer material, such as an open cell polyurethane foam, and have a density ranging from about 1.5 lb/ft$^3$ to about 8.0 lb/ft$^3$, and preferably from about 3.0 lb/ft$^3$ to about 5.0 lb/ft$^3$. In addition, the upper support layer 262 preferably has an IFD$_{25}$ ranging from about 5 lbf to about 20 lbf, and more preferably from about 8 lbf to about 15 lbf. The foundation support layer 268 preferably is formed of a cellular polymer material that has a density ranging from about 1.0 lb/ft$^3$ to about 3.0 lb/ft$^3$, and preferably from about 2.4 lb/ft$^3$ to about 2.8 lb/ft$^3$. In addition, the foundation support layer 268 may be formed of a cellular polymer material that has an $IFD_{25}$ ranging from about 5 lbf to about 250 lbf, and preferably from about 50 lbf to about 70 lbf.

One or more of the elements included within each respective system 10, 100, 200 disclosed herein may also incorporate antimicrobial devices, agents, etc. Because air and vapors can carry bacteria, viruses, and other potentially harmful pathogens, the systems may be provided with devices and agents that prevent, destroy, mitigate, repel, trap, and/or contain potentially harmful pathogenic organisms. In addition to bacteria and viruses, such organisms include, but are not limited to, mold, mildew, dust mites, fungi, microbial spores, bioslimes, protozoa, protozoan cysts, and the like. Preferred antimicrobial devices and agents include ULTRA-FRESH manufactured by Thompson Research Associates, Toronto, Canada.

EXAMPLES

The following examples were performed to measure Evaporative Capacity and Heat Loss (i.e., heat withdrawal) of foam support surfaces. The following testing conditions, therefore, were meant to simulate body loading conditions of foam testing support surface(s), having a flat profile, as particularly shown in body support systems 10, 100, 200, described above.

Testing equipment included: (1) a conditioned foam testing support surface; (2) a measuring unit configured to control temperature and water supply on the foam testing support surface; (3) a thermal guard; (4) bedding and (5) weights.

For this test, the conditioned foam testing support surface was the uppermost surface of a foam mattress having a structure comparable to that shown in FIGS. 1-3. The support surface was conditioned in a testing environment having a temperature and humidity of 21±2° C. and RH at 50±10%.

The measuring unit included a metallic test plate, a heating element block with an internal heating element, and a temperature controller with a temperature sensor.

The thermal guard included a high thermal conductivity material with heating elements, a thermal guard temperature sensor, and a controller used to maintain the thermal guard temperature and the measuring unit at the same level. The thermal guard was used to prevent heat leakage from the measuring unit.

Bedding included a standard cotton bed sheet that covered the testing support surface, and a medium-weight cotton blanket over the cotton bed sheet.

Weights were used to maintain an average interface pressure over at the body-support surface interface between 0.5 psi and 0.7 psi.

Testing was performed over approximately a two-hour period and variables determined, according to the following:

(1) Measurement of Dry Heat Flux ($Q_{dry}$), where $Q_{dry}$ is defined as the heat flow per unit area from warmed the test plate into the cooler environment in response to the difference in temperature. This value is considered equivalent to a surface's ability to ward off heat accumulation on the skin in the absence of moisture; This parameter is expressed in terms of $W/m^2$.

(2) Measurement of Combined Heat Flux ($Q_{wet}$), where $Q_{wet}$ is the heat flow per unit area from a wetted test plate into the environment. This parameter relates to surface's ability to ward off heat accumulation on skin in the presence of moisture. This parameter also is expressed in terms of $W/m^2$.

(3) Calculation of Thermal Resistance ($R_{dry}$);

(4) Determination of Partial Pressure of Ambient Air ($P_a$) and Saturation Pressure of Measurement Plate ($P_m$);

(5) Calculation of Apparent Evaporative Resistance ($R_{wet}$);

(6) Calculation of Apparent Evaporative Heat Flux ($Q_{evap}$); and (7) Calculation of Evaporative Capacity (EvapCap), where EvapCap is defined as the rate at which a surface is capable of promoting the evaporation of the test plate. This parameter is expressed in terms of $g/m^2$ hr.

(1) Measurement of Dry Heat Flux ($Q_{dry}$)

a. The cotton bed sheet was positioned on the foam testing support surface of the mattress's uppermost comfort layer.

b. The HOB elevation angle of the mattress was set at 0°.

c. The measuring unit test plate was positioned in the sacral region of the foam testing support surface on top of the cotton bed sheet.

d. Six regions of the foam support surface were identified for measurement.

e. Weights were positioned on the measuring unit to load the unit to a mean pressure of about 0.5 psi.

f. The measuring unit and the weights were covered with the medium-weight blanket.

g. The test plate temperature was set to maintain 35° C.±2° C.

h. Over a 100-minute period, $Q_{dry}$ values were monitored and collected.

(2) Measurement of Combined Heat Flux ($Q_{wet}$)

a. The cotton bed sheet was positioned on the foam testing support surface of the mattress's uppermost comfort layer.

b. The HOB elevation angle of the mattress was set at 0°.

c. The measuring unit test plate was positioned in the sacral region of the foam testing support surface on top of the cotton bed sheet and also positioned to receive water flow.

d. Six regions of the foam support surface were identified for measurement in accordance with RESNA standards.

e. Weighted bags were positioned on the measuring unit to load the unit to a mean pressure of about 0.5 psi.

f. The measuring unit and the weighted bags were covered with the medium-weight blanket.

g. The test plate temperature was set to maintain 35° C.±2° C.

h. Over approximately a 60-minute period, $Q_{wet}$ values were monitored and collected.

(3) Calculation of Thermal Resistance ($R_{dry}$)

Thermal resistance ($R_{dry}$) was calculated according to the following formula:

$$R_{dry} = \frac{(T_m - T_a)}{Q_{dry}},$$

where $T_m$=temperature of the measuring unit in ° C. and $T_a$=temperature of the atmosphere in ° C.

(4) Determination of Partial Pressure of Ambient Air ($P_a$) and Saturation Pressure of Measurement Plate ($P_m$)

Full saturation ($P_{sat}$) (i.e., at 100% relative humidity) was determined from a saturated steam table. Partial Pressure ($P_a$) (except for full saturation) was determined by multiplying Saturated Pressure ($P_{sat}$) at specific temperatures by relative humidity (RH %).

(5) Calculation of Apparent Evaporative Resistance ($R_{wet}$)

Apparent Evaporative Resistance ($R_{wet}$) was calculated according to the following formula:

$$R_{wet} = \frac{(P_m - P_a)}{Q_{wet} - (T_m - T_a)/R_{dry}}$$

Calculate the apparent evaporative resistance for the surface under the selected test condition as the arithmetic mean of the six trials.

(6) Calculation of Apparent Evaporative Heat Flux ($Q_{evap}$)

Evaporative Heat Flux ($Q_{evap}$) was calculated according to the following formula:

$$Q_{evap} = \frac{(P_m - P_a)}{R_{wet}}$$

(7) Calculation of Evaporative Capacity (EvapCap)

Evaporative Capacity was calculated according to the following formula:

$$EvapCap = \frac{Q_{evap}}{1.49\ \text{g/m}^2 * \text{hr}}$$

Representative Data:

| Time (min) | $Q_{dry}$ | $Q_{we}$t | $R_{dry}$ | $R_{wet}$ | $Q_{evap}$ | EvapCap |
|---|---|---|---|---|---|---|
| 0.00 | 40.83 | 345.87 | 0.34 | 11.61 | 308.66 | 459.90 |
| 2.00 | 41.02 | 135.77 | 0.34 | 31.76 | 94.94 | 141.46 |
| 4.00 | 39.26 | 103.49 | 0.36 | 41.31 | 63.56 | 94.70 |
| 6.00 | 39.76 | 97.23 | 0.36 | 43.73 | 57.97 | 86.37 |
| 8.00 | 40.61 | 96.91 | 0.35 | 44.03 | 57.00 | 84.93 |
| 10.00 | 41.32 | 96.43 | 0.34 | 44.50 | 55.70 | 82.99 |
| 12.00 | 42.11 | 96.66 | 0.32 | 44.34 | 55.17 | 82.20 |
| 14.00 | 41.03 | 96.85 | 0.33 | 44.65 | 54.67 | 81.45 |
| 16.00 | 41.31 | 99.93 | 0.32 | 43.91 | 57.18 | 85.20 |
| 18.00 | 40.76 | 100.90 | 0.33 | 43.95 | 57.61 | 85.84 |
| 20.00 | 41.10 | 100.66 | 0.33 | 43.90 | 57.00 | 84.93 |
| 22.00 | 41.99 | 101.55 | 0.33 | 44.04 | 57.60 | 85.82 |
| 24.00 | 40.37 | 104.60 | 0.35 | 42.72 | 60.46 | 90.09 |
| 26.00 | 41.01 | 101.83 | 0.34 | 43.77 | 57.89 | 86.26 |
| 28.00 | 40.33 | 102.79 | 0.35 | 41.35 | 59.68 | 88.92 |
| 30.00 | 40.82 | 101.57 | 0.34 | 42.05 | 59.32 | 88.38 |
| 40.00 | 41.66 | 103.23 | 0.32 | 41.81 | 60.75 | 90.52 |
| 50.00 | 42.72 | 103.63 | 0.33 | 42.39 | 61.24 | 91.25 |
| 59.00 | 41.88 | 101.57 | 0.31 | 43.10 | 59.79 | 89.08 |

Figure 12:
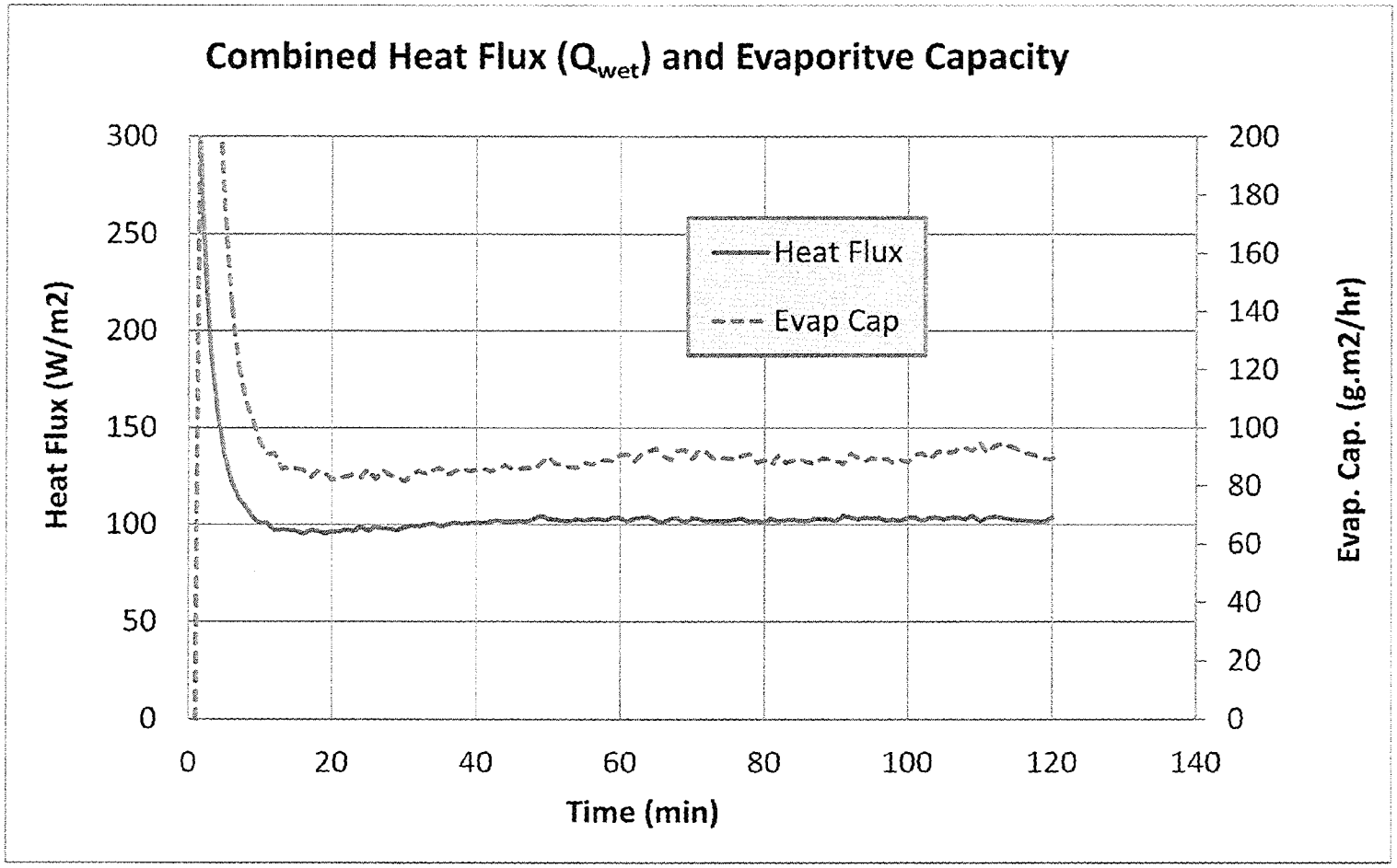
FIG. 12 is a graph of Combined Heat Flux and Evaporative Capacity data for one body support system according to the invention.

FIG. 12 shows a graph of $Q_{wet}$ and EvapCap data for a mattress of a configuration as shown in FIGS. 1-3 measured over a period of approximately 120 minutes.

Thus, various configurations of body support systems are disclosed. While embodiments of this invention have been shown and described, it will be apparent to those skilled in the art that many more modifications are possible without departing from the inventive concepts herein. Moreover, the examples described herein are not to be construed as limiting. The invention, therefore, is not to be restricted except in the spirit of the following claims.

What is claimed is:

1. A body support system, comprising:

at least one uppermost comfort layer, having a support surface, disposed above a central core of the body support system, the uppermost comfort layer comprising a temperature and pressure sensitive cellular polymer material;

a foundation support layer comprising a cellular polymer material, the foundation support layer having a bottom surface forming a bottommost outwardly facing surface of the body support system, the central core between the uppermost comfort layer and the foundation support layer;

an air flow guide comprising a low air loss material that is disposed within the central core of the body support system, the air flow guide comprising an upper body portion, a central body portion adjacent the upper body portion, and a lower body portion in an overlapped relationship with the central body portion, wherein each of the upper body portion, the central body portion, and the lower body portion comprises open cell polyurethane foam, the air flow guide forming an air flow path within the central core of the body support system for air and/or moisture vapor transport transportable;

a support layer comprising a cellular polymer material disposed within the central core between the air flow guide and the foundation support layer of the body support system;

at least one electrically driven air flow unit, disposed within a cavity in the body support system, coupled and adjacent to the lower body portion, wherein during operation, the at least one electrically driven air flow unit draws air and moisture vapor away from the at least one uppermost comfort layer through the upper body portion, the central body portion, and the lower body portion such that air along the air flow path is exhausted out of the at least one electrically driven air flow unit to evacuate air and evaporate moisture vapor from the body support system.

2. The body support system of claim 1, wherein the temperature and pressure sensitive cellular polymer material comprises viscoelastic open cell polyurethane foam.

3. The body support system of claim 2, wherein the viscoelastic open cell polyurethane foam is reticulated.

4. The body support system of claim 1, wherein the air flow guide comprises a material selected from the group consisting of: cellular polymer, reticulated open cell polyurethane foam, nonwoven fibrous batt, reticulated rebonded polyurethane foam, and polyamide.

5. The body support system of claim 1, wherein the air flow guide comprises multiple portions disposed in overlapping relation within the core of the body support system.

6. The body support system of claim 1, wherein the air flow guide comprises multiple portions disposed in generally parallel relation within the core of the body support system.

7. The body support system of claim 1, wherein the air flow path extends from an inlet disposed in the body support system, through the air flow guide and out of the air control unit, with said inlet, air flow guide and air control unit all disposed under the uppermost comfort layer.

8. The body support system of claim 1, further comprising a second air flow unit.

9. The body support system of claim 1, wherein moisture vapor is evacuated from the uppermost comfort layer at an Evaporative Capacity in the range of about 10 $gm^2$/hr. to about 150 $gm^2$/hr.

10. The body support system of claim 1, wherein heat is withdrawn from the uppermost comfort layer at a Heat Withdrawal Capacity in the range from about 10 $W/m^2$ to about 300 $W/m^2$.

11. An encased body support system comprising:

the body support system of claim 1; and a waterproof, moisture vapor permeable cover encasing the body support system.

12. A body support system for supporting a body in a supine position comprising:

at least one uppermost layer having a support surface forming an uppermost outwardly facing surface of the body support system;

a foundation support layer comprising a cellular polymer material, the foundation support layer forming a bottommost outwardly facing surface of the body support system;

a central core between the uppermost comfort layer and the foundation support layer, the central core comprising:

an air flow guide forming at least one air flow path within the central core of the body support system, the air flow guide including a central body portion in register with a torso of the supine body, a lower body portion in register with the supine body below the torso, and an upper body portion in register with the supine body above the torso, and the upper body portion is positioned vertically higher relative to the central body portion and the central body portion is positioned vertically higher relative to the lower body portion;

a support layer comprising a cellular polymer material disposed within the central core between the air flow guide and the foundation support layer of the body support system; and at least one electrically driven air flow unit, disposed within a cavity in the central core, the air flow unit in fluid communication with the air flow guide and configured to exhaust air in the air flow guide to an environment external to the body support system.

13. A body support system for supporting a body in a supine position, the body having a torso, comprising:

at least one uppermost layer having a support surface forming an uppermost outwardly facing surface of the body support system;

a foundation support layer comprising a cellular polymer material, the foundation support layer forming a bottommost outwardly facing surface of the body support system;

a central core between the uppermost comfort layer and the foundation support layer, the central core comprising:

an air flow guide forming at least one air flow path within the central core of the body support system;

a support layer comprising a cellular polymer material disposed within the central core between the air flow guide and the foundation support layer of the body support system, the support layer including a central support layer in register with the torso of the supine body, a lower support layer in register with the supine body below the torso, and an upper support layer in register with the supine body above the torso, and the central support layer has a central-support-layer density, the lower support layer has a lower-support-layer density and the upper support layer has an upper-support-layer density, the central-support-layer density being different than the lower-support-layer- density or the upper-support-layer density; and at least one electrically driven air flow unit, disposed within a cavity in the central core, the air flow unit in fluid communication with the air flow guide and configured to exhaust air in the air flow guide to an environment external to the body support system.

* * * * *